United States Patent [19]

Van Orden

[11] 4,114,801

[45] Sep. 19, 1978

[54] RETRACTABLE MAILBOX

[76] Inventor: John J. Van Orden, 527 Santa Ana Ave., Newport Beach, Calif. 92660

[21] Appl. No.: 761,709

[22] Filed: Jan. 24, 1977

Related U.S. Application Data

[63] Continuation of Ser. No. 632,246, Nov. 17, 1975, abandoned, which is a continuation of Ser. No. 505,595, Sep. 12, 1974, abandoned.

[51] Int. Cl.[2] ..... B65D 91/00

[52] U.S. Cl. ..... 232/17; 232/45; 232/39; 52/169.6

[58] Field of Search ..... 232/17, 45, 39, 37; 52/169, 111

[56] References Cited

U.S. PATENT DOCUMENTS

| | | | |
|---|---|---|---|
| 2,189,486 | 2/1940 | D'Amico | 52/169 X |
| 2,703,634 | 3/1955 | Lee | 52/111 X |
| 2,708,493 | 5/1955 | Badertscher | 52/111 X |
| 2,826,280 | 3/1958 | Troche et al. | 52/111 X |
| 3,214,156 | 10/1965 | Klose et al. | 52/169 X |
| 3,593,914 | 7/1971 | Van Orden | 232/17 |
| 3,611,333 | 10/1971 | Conigliaro | 232/37 |

*Primary Examiner*—Roy D. Frazier
*Assistant Examiner*—Peter A. Aschenbrenner
*Attorney, Agent, or Firm*—Poms, Smith, Lande & Glenny

[57] ABSTRACT

A retractable mailbox assembly includes three concentric cylinders with the outer mounted underground and the middle and inner cylinders telescopically mounted to rise out of the ground in response to air pressure with the middle cylinder mounted to rise linearly a predetermined height and latched at that height by magnetic latches and the inner cylinder mounted to rise an additional predetermined height beyond that of the middle cylinder to permit a rotatable mailbox pivotally mounted at the top of the inner cylinder to be opened by a rack and pinion mechanism to permit depositing or withdrawal of mail. Air pressure to raise the middle and inner cylinders is transmitted from water cooled air storage means, illustratively a plurality of storage pipes, through an air diffuser controlled by a pneumatic solenoid valve. The pneumatic valve is controlled by a time delay relay of a switching system which is actuated in response to a signal transmitted from either a mailman's transmitter or a user's transmitter to thereby open the mailbox and retain it open for a predetermined period of time determined by the time delay relay. At the end of that predetermined period, the relay actuates a compressor which evacuates the interior of the cylinders and pumps air back into the storage means thereby closing the mailbox and retracting the inner and middle cylinders into the outer cylinder. Make-up air during and after retraction is admitted through a suitable check valve. The switching system also includes signaling means for signaling the user that the mailbox is being or has been serviced by the mailman. It further includes signaling means for signaling the mailman that mail has been deposited by the user. Drainage means is provided for draining water from the bottom of the outer cylinder into a suitable underground drain.

14 Claims, 14 Drawing Figures

82
79
69
71
68
78
72
83
67
77
74
81
83
59
73
76
21
22
20
23
87
39
66
29
64
86
44
84
24
63
62
61
41
46
47

RETRACTABLE MAILBOX

This is a continuation of application Ser. No. 632,246, filed Nov. 17, 1975, which was a continuation of application Ser. No. 505,595, filed Sept. 12, 1974, both now abandoned.

BACKGROUND OF THE INVENTION

This invention relates to mailboxes, and more particularly to a curbside mailbox which is normally retracted into the ground and which rises vertically in response to pneumatic pressure to a height above the ground to receive or deliver mail.

Typical prior art suburban and rural mailboxes have been designed basically to include a rounded top and a hinged front door mounted on the upper end of a post which is secured into the ground. Such boxes typically require a pivoting flag for signaling that there is mail to be picked up. Such mailboxes are susceptible to tampering and destruction by the elements. Similarly, the mail therein is susceptible to being stolen or damaged by the elements. For example, freezing weather makes the door of such a typical curbside mailbox difficult to open or close. Rain causes the box to rust and the mail to be soaked.

Such typical prior art mailboxes present a traffic hazard to motorists who misjudge the location of the curb during parking. Thus, such mailboxes not only may cause damage to the vehicle but may also be knocked down by the vehicle. Furthermore, they frequently lack a stylish design and do not comport with the aesthetic appearance of modern suburban and rural homes.

In my prior U.S. Pat. No. 3,593,914, I disclosed a retractable mailbox assembly which is reset into the ground adjacent to the curb. The retractable mailbox disclosed in my prior patent includes an open-ended hollow housing recessed into the ground with the outer upper end flush with the surrounding surface. A supporting pedestal is movable by a key triggered electric motor between a retracted position with the outer end flush with the surrounding area and an extended position projecting out of the housing with a mail receiving receptacle in a mail receiving position. The electric motor drive is controlled by a suitable switching system.

The present invention is more compact than the invention disclosed in my prior patent and simpler in design and construction. Furthermore, the total height and crosssectional area of the present invention are less than the height and cross-sectional area respectively of the invention disclosed in my prior patent with a corresponding reduction in the cost of construction. The simplification of the retractable mailbox provided for by my present invention reduces wear and tear and correspondingly increases the useful life thereof.

SUMMARY OF THE INVENTION

The retractable mailbox assembly according to the present invention includes three concentric cylinders with the outer mounted underground and the middle and inner cylinders telescopically mounted to rise out of the ground by a force exerted by air pressure against a piston on the inner cylinder. The air pressure to raise the middle and inner cylinders is transmitted from water-cooled air tanks through an air diffuser controlled by a pneumatic solenoid valve. The middle and inner cylinders are latched by a first magnetic latch which causes them to rise in unison up to a first predetermined height at which point the middle cylinder is then latched by a second magnetic latch to the outer cylinder. The air pressure against the piston of the inner cylinder causes it to overcome the force of the first magnetic latch. The inner cylinder then continues to rise a second predetermined height to permit a pivotally mounted mail receiving receptacle at the top of the inner cylinder to be opened by a rack and pinion mechanism to permit depositing or withdrawing of mail.

The pneumatic solenoid valve which activates the air diffuser to apply air pressure to the piston to raise the middle and inner cylinders is controlled by a switching system which is actuated in response to a signal transmitted from either a mailman's transmitter or a user's transmitter to thereby raise the middle and inner cylinders and open the mailbox. A time-delay relay in the switching system retains the box open for a period determined by the time-delay relay. The switching system further controls visual and audible signaling means in the user's house to signal the user that mail has been deposited in the box. It further controls visual signaling means adjacent the box to signal the mailman that there is mail to be picked up.

A compressor mounted in the lower part of the inner cylinder, and which may be surrounded by a water-cooled tank, is actuated by the switching system at the end of the delay period of the time delay relay to compress the air which originally raised the cylinders. The middle and inner cylinders are thereby retracted downwardly into the fixed outer cylinder. Supply or make-up air for the compressor is admitted from the atmosphere through a suitable check valve.

Accordingly, an object of the present invention is to provide a novel curbside mailbox which retracts into the ground between periods of use.

Another object of this invention is to provide a pneumatically operated retractable mailbox means having telescopic cylinders.

Still another object is to provide switching means for activating a pneumatic device to open a retractable mailbox and retain it open for a predetermined period of time and for activating a compressor for closing the mailbox at the termination of the predetermined period of time.

Yet another object of the present invention is to provide signalling means for signalling either a mailman or a user of a retractable mailbox that there is either incoming or outgoing mail deposited in the mailbox.

Yet a further object is to provide magnetic latching means having a first latch for latching the inner and middle cylinders of a retractable mailbox during one portion of the opening cycle and a second latch for latching the middle and outer cylinders during the subsequent portion of the opening cycle.

These and other features of the present invention will become apparent from the following detailed description and drawings of a preferred embodiment.

DETAILED DESCRIPTION OF THE PREFERRED EMBODIMENT

Figure 1:
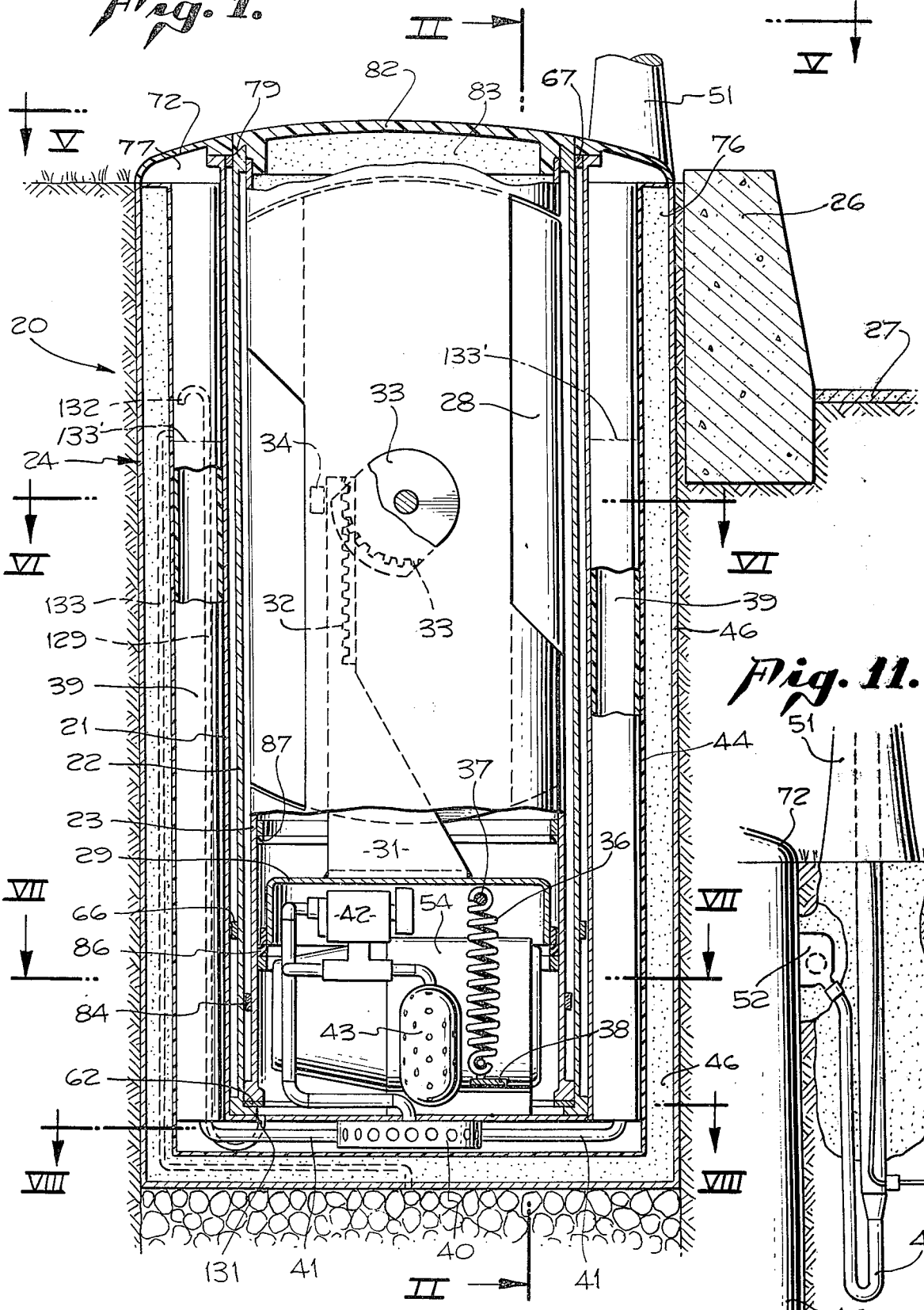
FIG. 1 is a vertical sectional view of the mailbox assembly of the present invention showing the two internal cylinders in their retracted position within the outer cylinder.

Referring now to FIG. 1, there is shown the retractable mailbox 20 having a plurality of telescopic members in the form of concentric cylinders 21, 22 and 23. The outer cylinder 21 is fixedly mounted in a housing indicated generally at 24, embedded in the ground in close proximity to a curb 26 of a thoroughfare 27 as shown.

Figure 3:
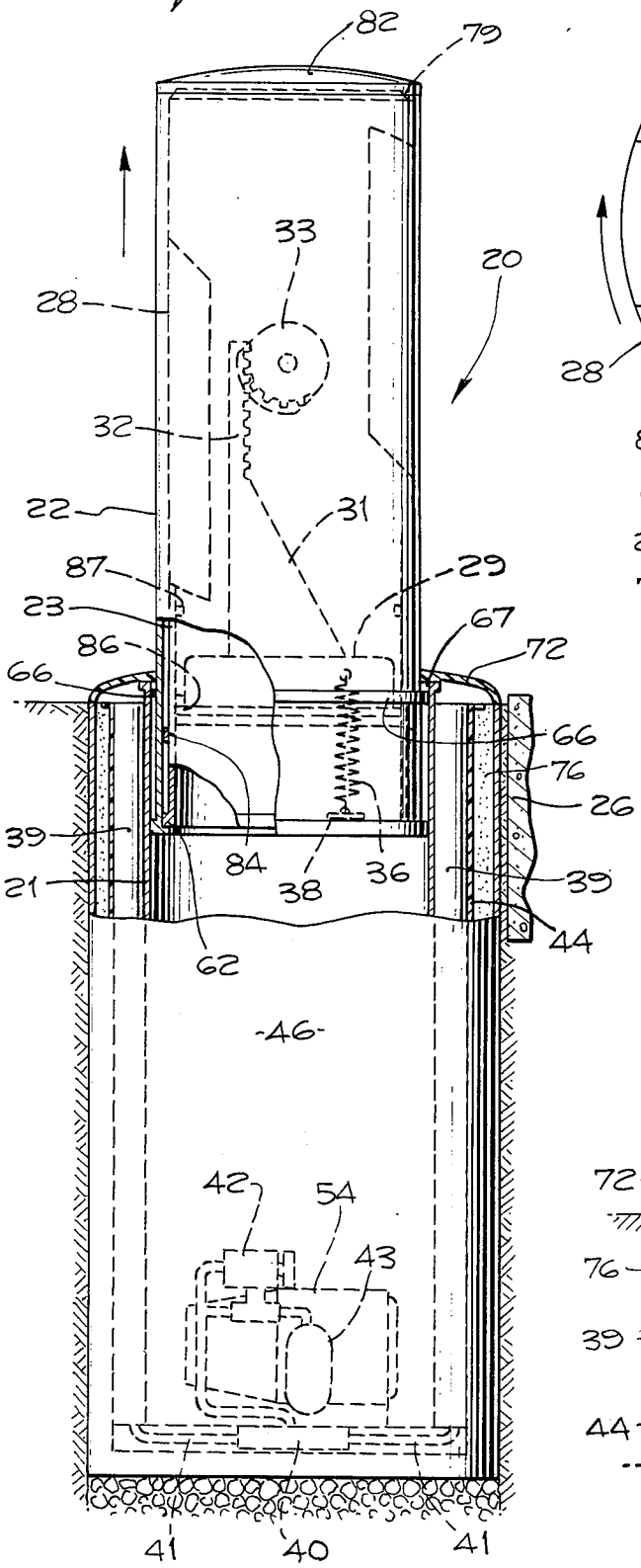
FIG. 3 is a vertical sectional view of the mailbox assembly in its intermediate extended position.
Figure 4:
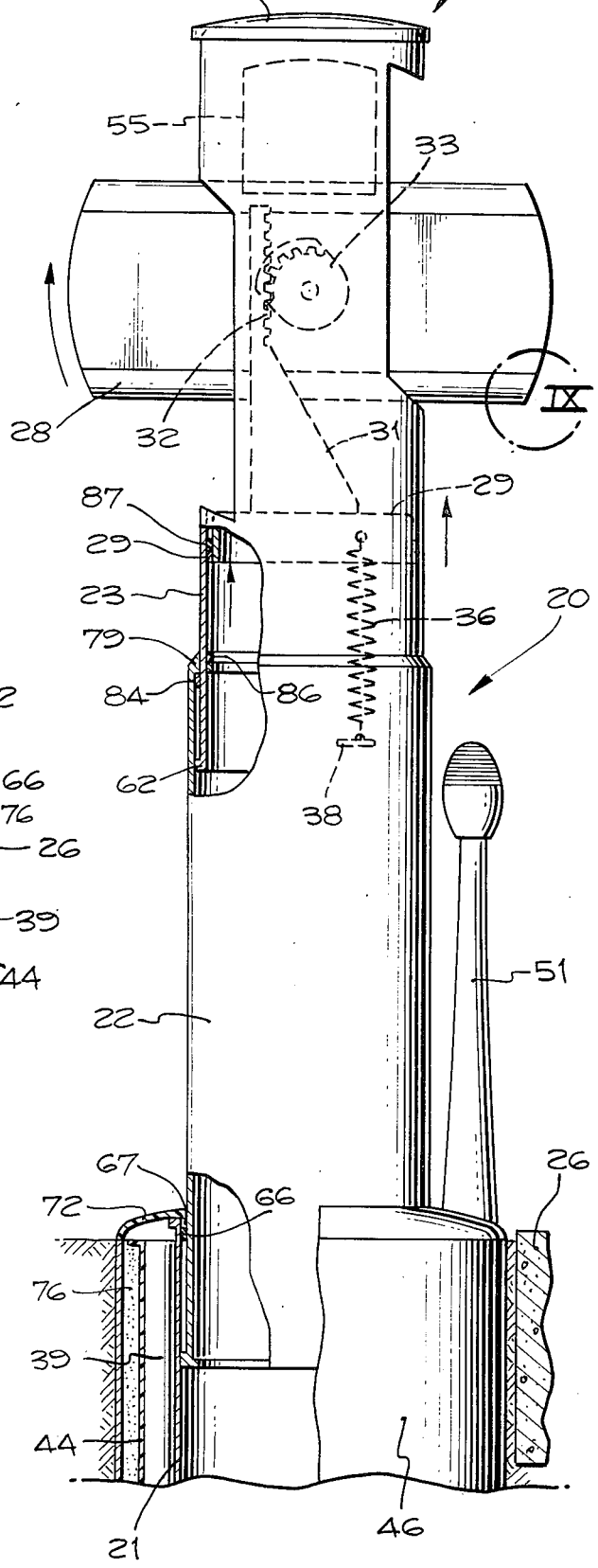
FIG. 4 is a partial vertical sectional view showing the mailbox of the present invention in its fully extended position and the mail receiving receptacle in its horizontal operative position, providing access for the user or mailman to deposit or withdraw mail.

The middle cylinder 22 is mounted within cylinder 21 and adapted for rising linearly a predetermined height above the surface of the ground as shown in greater detail in FIGS. 3 and 4.

The inner cylinder 23 is slidably mounted within the middle cylinder 22 to extend a further distance above the maximum height of the middle cylinder to permit a pivotally mounted mail receiving receptacle 28 to be opened for depositing or withdrawing of the mail. The inner cylinder 23 further contains piston means in the form of piston 29 against which a force is imparted by air pressure to raise the middle and inner cylinders.

Figure 6:
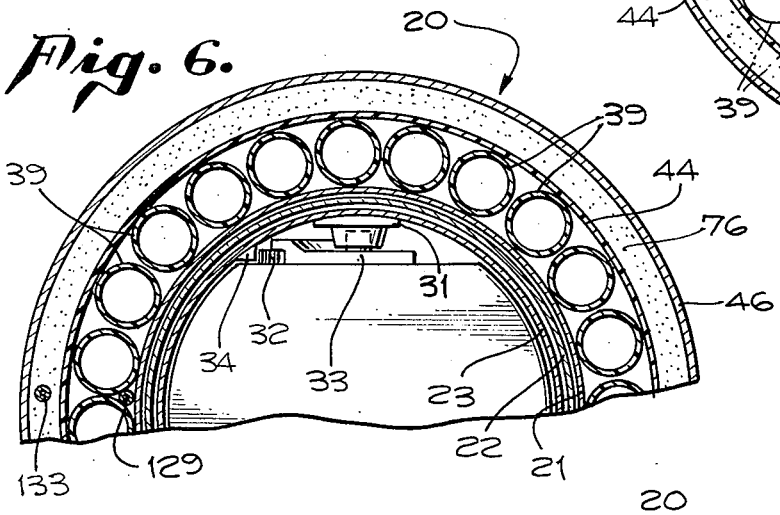
FIG. 6 is a partial horizontal cross-sectional view of the mailbox of the present invention taken along the plane VI—VI of FIG. 1.

The piston 29 has a rack and pinion mechanism as shown in the horizontal cross-sectional view of FIG. 6. The mechanism includes a bracket 31 mounted thereon with a rack 32 having gear teeth for engaging a pinion 33 for rotating the mail receiving receptacle 28. The rack is maintained in its position by a guide 34.

A pair of springs 36 are secured to the piston 29 by bolts 37 and secured to the bottom of the inner cylinders 23 by securing members 38 to spring bias the piston 29 downwardly. The mail receiving receptacle 28 is thereby retained normally in the vertical position as shown in FIG. 3. As will be explained more fully hereinafter, the piston 29 is urged upwardly against the bias of springs 36 by pneumatic pressure to permit the mail receiving receptacle 28 to be completely open as shown in FIG. 4.

Figure 8:
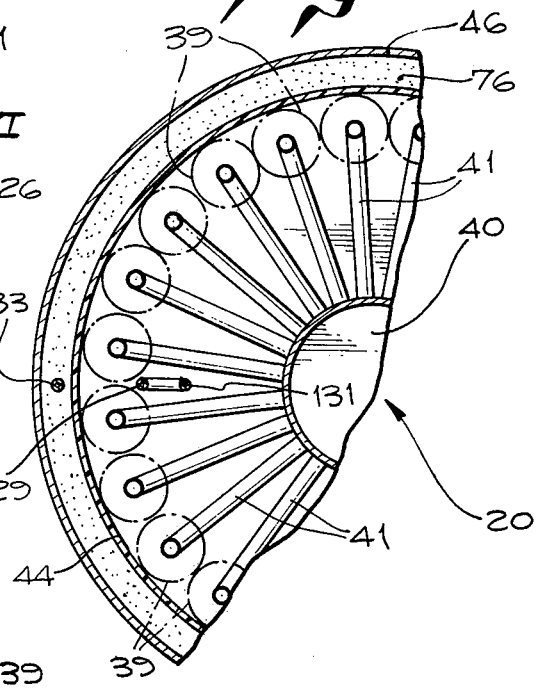
FIG. 8 is a partial horizontal cross-sectional view of the mailbox showing a portion of the compressed air storage system of the present invention taken along the plane of VIII—VIII of FIG. 1.
Figure 7:
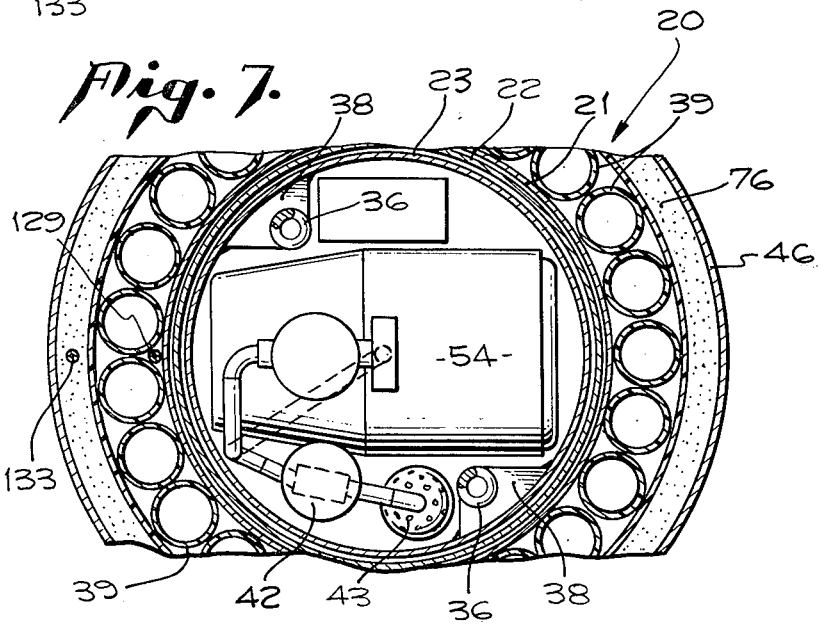
FIG. 7 is a partial horizontal cross-sectional view of the mailbox showing parts of the compressor system and taken along the plane VII—VII of FIG. 1.
Figure 14:
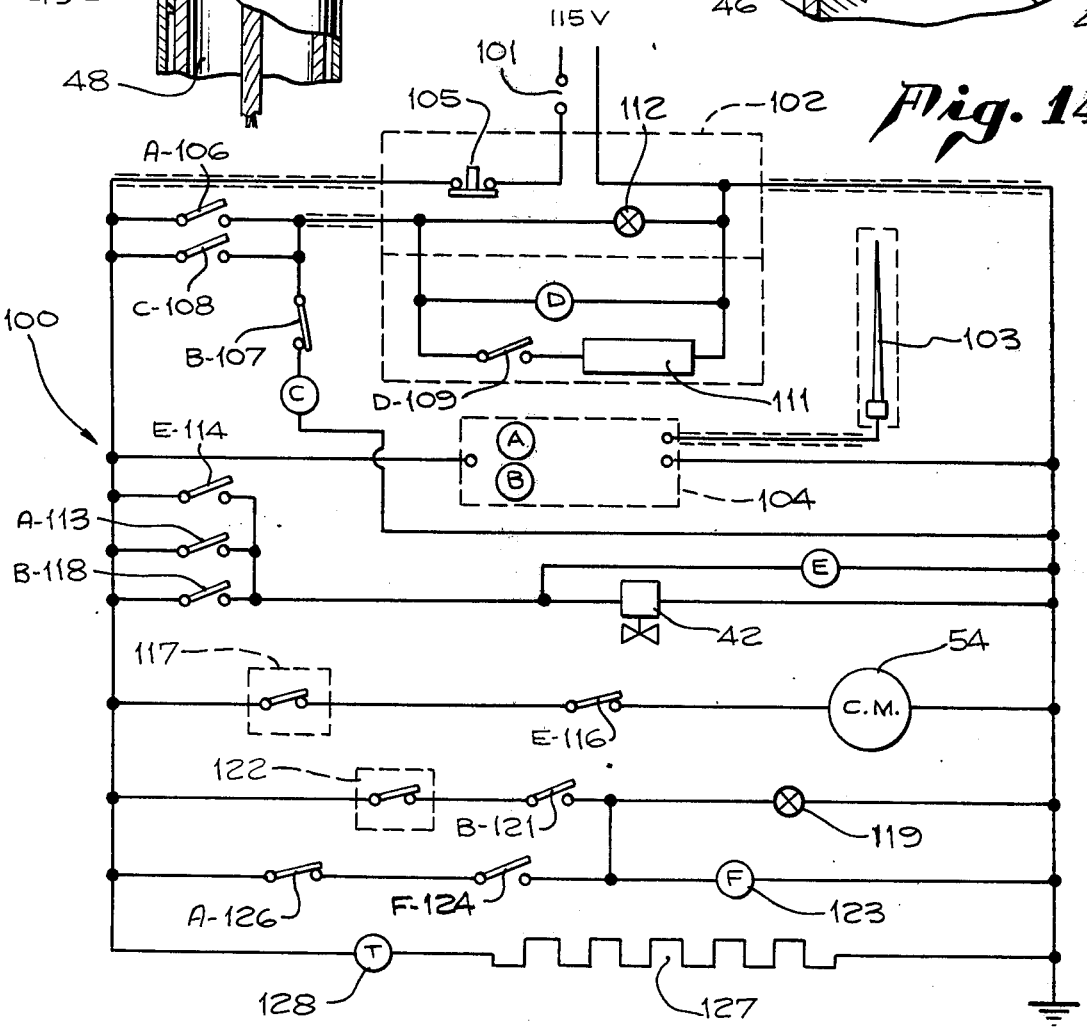
FIG. 14 is a schematic diagram of the switching system for controlling the present invention.

Air pressure is applied through pressure means to raise the piston. The air pressure is obtained from compressed air stored in air storage means in the form of pipes 39 shown in cross-section in FIGS. 6 and 7 and in FIG. 8 in phantom. When the mailbox is in the retracted position, the air is stored preferably at a pressure of approximately 95 to 100 psig. Air pressure is transmitted to the space between outer cylinder 21 and the piston 29 via tubes 41 shown in FIG. 8, through collection chamber 40, shown in FIGS. 1 and 8, pneumatic solenoid valve 42 and air diffuser 43. The air diffuser 43 efficiently distributes the air under pressure throughout the space between the outer cylinder 21 and the piston 29 to provide optimum use of the air pressure to exert a force against the piston. The pneumatic solenoid valve 42, shown schematically in the circuit diagram of FIG. 14 releases pneumatic pressure stored in pipes 39. It is controlled by the switching circuit disclosed in FIG. 14 as will be explained more fully hereinafter.

The storage pipes 39 are mounted in water which surrounds them in the space between the outer cylinder 21 and a waterproof membrane 44 and has a volume of the order of 7 gallons and is of the order of 24 inches high in the preferred embodiment. The air storage pipes 39 contain approximately 1 cubic foot of compressed air when the mailbox is in the retracted position. The 7 gallons of water surrounding the air storage pipes provide cooling for the pipes to absorb the heat from the compressed air.

Figure 2:
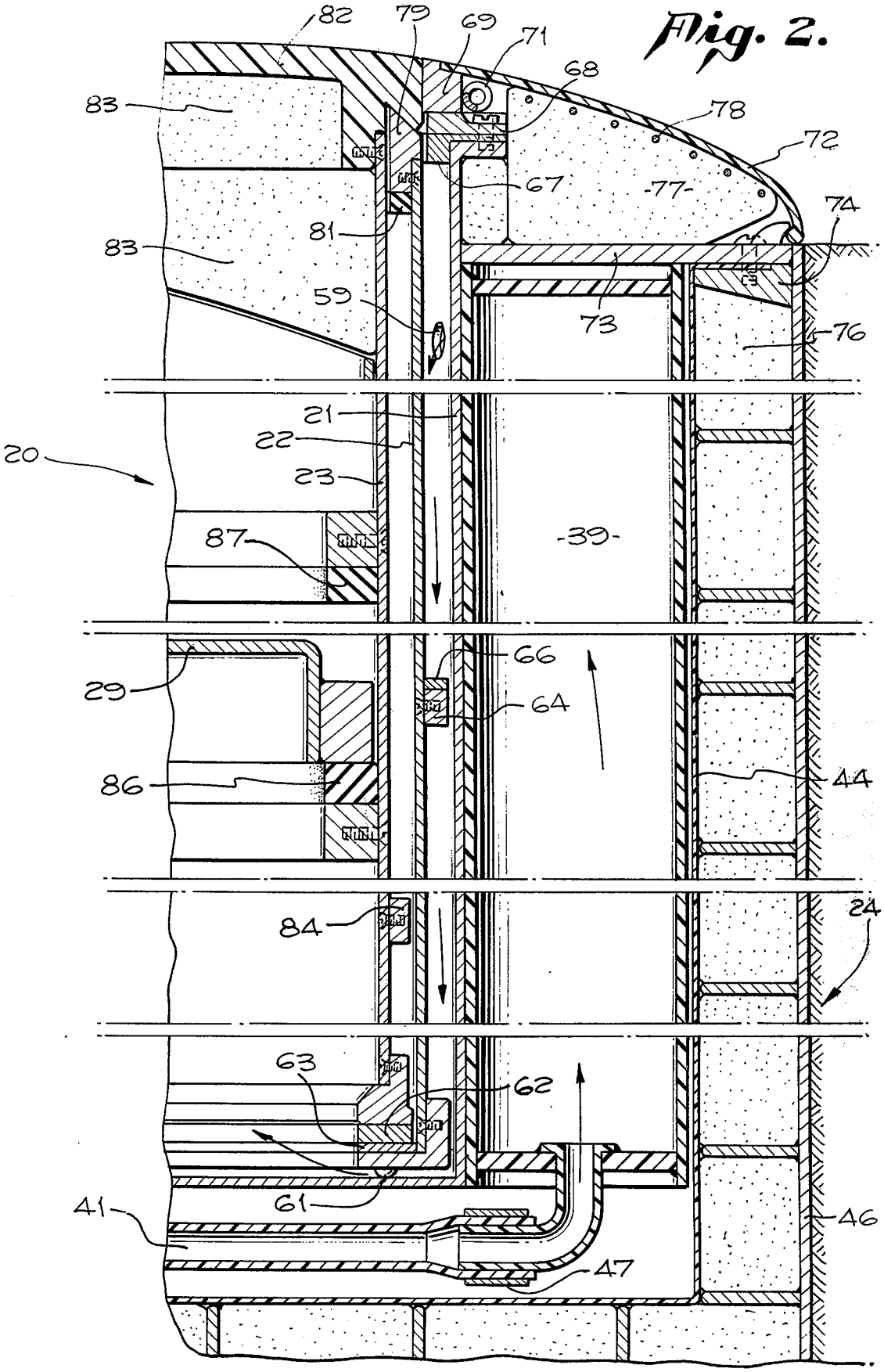
FIG. 2 is a fragmentary vertical sectional view taken on an enlarged scale and with intermediate portions broken away, along the plane II—II of FIG. 1.

As shown in FIG 2, the air storage pipes 39 are located in a housing 46 embedded in the ground and are secured to the tubes 41 by clamps 47. The air storage pipes are preferably in the order of 1½ inch diameter polyvinylchloride pipes and the tubes 41 are preferably a quarter inch diameter polyvinylchloride tubes.

Figure 11:
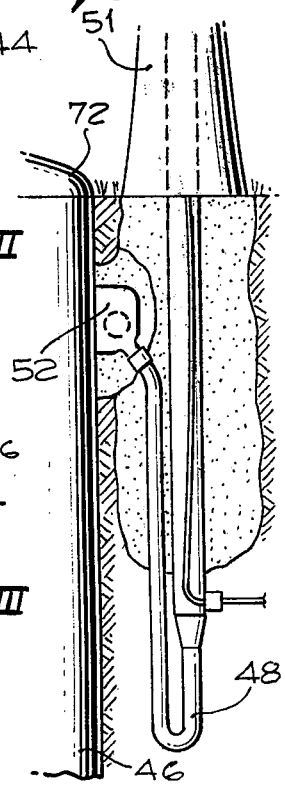
FIG. 11 is a partial vertical cross-sectional view of the air supply system for supplying air to the compressor.
Figure 13:
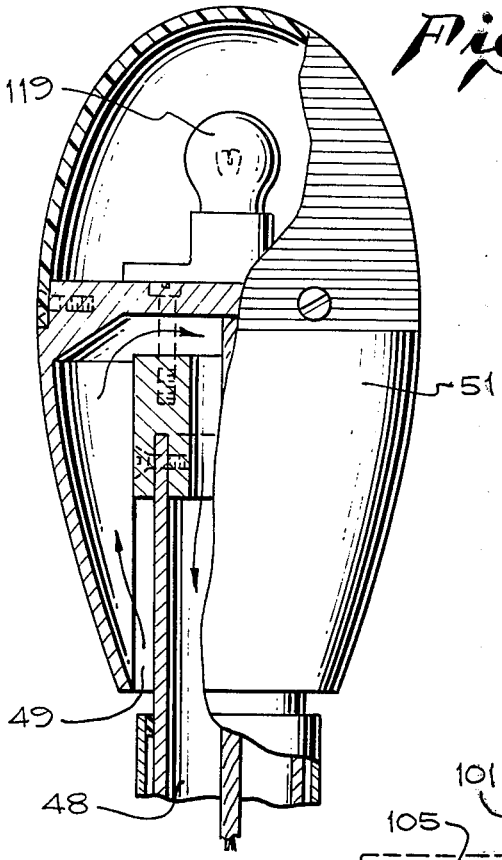
FIG. 13 is a vertical sectional view of the upper part of the outdoor signal lamp post with portions broken away.
Figure 12:
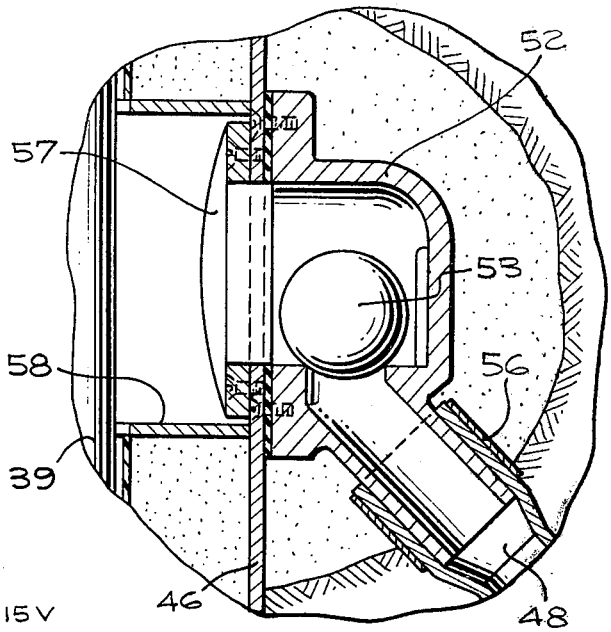
FIG. 12 is a detail sectional view of the check valve of the air supply system taken along the plane XII—XII of FIG. 5.

Outside make-up air is supplied to the system through air supply means having a tube 48 in the shape of a manometer tube as shown in FIG. 11. The air enters through the orifice 49 of the lamp post 51 as shown in FIG. 13. The air is transmitted through the air path of the tube 48 and through a check valve 52 shown in FIG. 12. The check valve has a steel ball 53 to provide one-way flow of supply air from the atmosphere to be used by a compressor 54 to compress air into the air storage pipes 39. The tube 48 is secured to the check valve by a suitable clamp 56, and a removable louver 57 is positioned on the check valve 52 as shown in FIG. 12 for servicing of the check valve. Housing 24 may include a number of stiffeners, one of which is indicated at 58, extending inwardly from the housing outer wall 46.

The air transmitted from the check valve is passed through an orifice 59, shown in FIG. 2, (located above water level 133' shown in FIG. 1 and described below) and between outer cylinder 21 and middle cylinder 22. The air seeps between a series of buttons 61 underneath the middle cylinder 22 to the compressor 54. The compressor is operative in response to the circuitry shown in FIG. 14 to compress the air through the tubes 41 to the air storage pipes 39.

In the retracted position, as shown in FIG. 2, the middle cylinder 22 is latched to the inner cylinder 23 by latching means in the form of magnets 62 mounted on the inner cylinder 23 which contact a ferromagnetic material secured to the bottom periphery of the middle cylinder 22. The ferromagnetic material is preferably in the form of a steel ring 63 and the magnets 62 are spaced circumferentially around the bottom of middle cylinder 22. The magnets form a flux pattern which exerts a pull on the steel ring 63 of a force in the order of eighty pounds.

The magnets 62 latch the inner and middle cylinders together so that when air pressure is exerted against the piston 29 to raise it a predetermined height as shown in FIG. 3, the middle and inner cylinders will rise in unison. The middle cylinder 22 has a ring stop 64 having a steel plate 66 secured thereon to be latched to magnets 67 mounted circumferentially around the outer cylinder 21 at the top thereof and secured through a securing member 68. As the middle and inner cylinder rise in unison, when the plate 66 engages magnets 67, the magnets 67 retain middle cylinder 22 latched to outer cylinder 21 to retain the middle cylinder at the predetermined height shown in FIG. 3 while the inner cylinder rises to the predetermined height shown in FIG. 4.

A tight fitting seal 69 is urged against the surface of middle cylinder 22 by a spring 71. The seal 69 is covered by a plastic cover 72. The cover can have any decorative design or color to enhance the appearance of the mailbox. The seal retains the assembly airtight and prevents rain and snow from seeping into the internal mechanism.

A support flange 73 supports the mechanism and permits complete removal of the internal mechanism for service and repair. The support flange is normally secured to a housing support 74 secured to the housing 46 which is embedded in the soil. The housing support 74 is mounted at the top of a layer of insulation 76 which insulates the mechanism from the surrounding elements.

Support flange 73 is substantially covered by a layer of insulation 77 which further insulates the mechanism. A series of heaters 78 may be embedded in the insulation 77 to melt away snow and ice which collects on top of the mailbox when in the retracted position.

Figure 5:
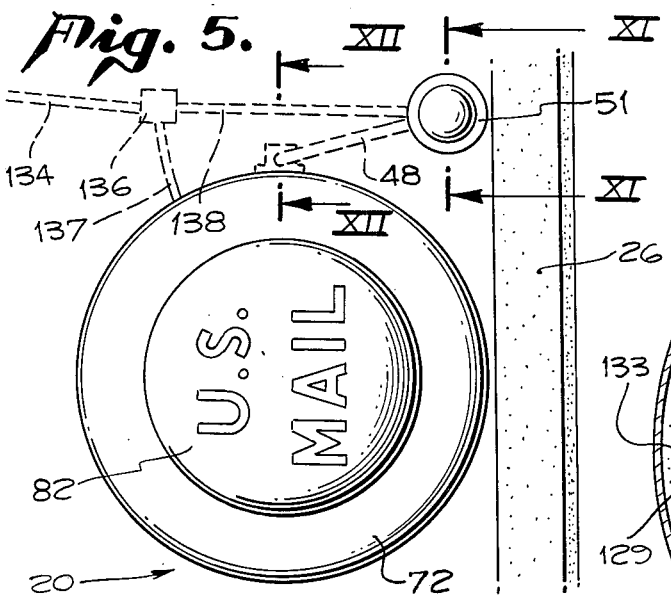
FIG. 5 is a plan view of the mailbox in the retracted position taken along the plane V—V of FIG. 1.

The middle cylinder has a cap 79 and a rubber seal 81 secured thereto at the top as shown in FIG. 2. In the retracted position, the cap which has a surface at 45° to the horizontal engages a plastic top 82 of the inner cylinder which fits snugly against the tight-fitting seal 69 to shield the mailbox from the surrounding elements. The plastic top 82 may have an appropriate sign or an attractive color scheme as shown in FIG. 5. A layer of insulation 83 is formed underneath the plastic top 82 to further insulate the mechanism from the elements.

The inner cylinder 23 has a stop 84 for engaging the rubber seal 81 when the inner cylinder is in its fully extended position as shown in FIG. 4. While inner cylinder 23 is moving from the position shown in FIG. 3 to that shown in FIG. 4, a small air gap exists between the middle cylinder 22 and the stop 84 permitting air to escape therethrough. However, when inner cylinder 23 reaches its fully extended position as shown in FIG. 4, the stop 84 is urged against the seal 81 secured to the cap 79 to reduce their leakage to zero.

Ordinarily, piston 29 rests on a rubber seal 86 which acts as a bottom stop for the piston as shown in FIGS. 2 and 4. As the pressure on piston 29 increases, it is urged upwardly against the bias of springs 36. A minor amount of air leakage is permitted between the piston 29 and the inner cylinder 23 after the piston 29 loses contact with the seal 86. The piston 29, however, abuts against an upper seal 87 when the mailbox is in its fully extended position to thereby close off air leakage.

Figure 10:
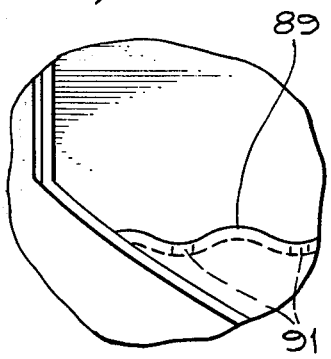
FIG. 10 is a fragmentary cross-sectional view of the receptacle for mail showing the drainage holes and taken along the plane of X—X of FIG. 9.
Figure 9:
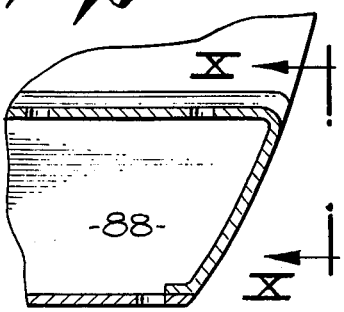
FIG. 9 is a vertical sectional view of a portion of the mail receiving receptacle within the dotted circle IX of FIG. 4.

In order to assist during retraction of the assembly, the inner cylinder 23 is desirably made to be quite heavy, and may thus be provided in its upper portion with a pair of lead weights, one of which is indicated at 55 in FIG. 4, spaced symmetrically on either side of the upper part of mailbox 28 in its retracted position. In the fully extended position of the piston 29, the receptacle 28 is rotated by the upward movement of the rack 32 to impart rotation through pinion 33 as shown in FIGS. 3 and 4. The receptacle 28 has a void space 88 as shown in FIG. 9 which may be used for drainage and for a coil drawer. A corrugated surface 89 shown in FIG. 10 has a plurality of holes 91 through which rain and melted snow drain into the void space 88 to thereby prevent the mail deposited in the receptacle 28 from being soaked on rainy and snowy days.

Switching means 100 controls the expansion and retraction of the mailbox in predetermined sequential phases. The switching means 100 is supplied by a standard 115 volt power source through a circuit breaker 101 and a pushbutton switch 105. The dotted lines around the wires signify underground wiring. The rectangle 102 shown in dotted line is the portion of the circuit which is indoors of the user's house.

The circuit is initially activated by a signal from a transmitter retained by either the mailman or the user and received by signal receiving means shown as antenna 103. The signals received by the antenna are transmitted to control elements in the form of relay means 104. The relay means contains a first relay solenoid A which is energized by a signal received from the mailman's transmitter. The relay means further contains a second relay solenoid B which is energized by a signal received from the user's transmitter.

When the mailman transmits a signal to energize the solenoid of relay A of relay means 104, relay contact A-106 is closed. The closure of contact A-106 signals the user that the mailbox is about to be or has been serviced by the mailman. Voltage is applied via normally closed contact B-107 to the solenoid of relay C to close contact C-108 to keep relay C locked closed. The closed contact C-108 transmits electrical energy to the solenoid of a time-delay relay D of the indoor portion of the electrical circuit 102. The time-delay relay D has a contact D-109 which is series connected to a chime or other audible signaling device 111 to audibly indicate to the user in his house that the mailbox has received an initiating signal from the mailman. Time-delay relay D is constructed to retain contact D-109 closed for approximately forty seconds to thereby signal to the user for about forty seconds that the mailbox has received an initiating signal from the mailman to thereby permit the user to collect the mail immediately upon its deposit by the mailman to the mailbox. The indoor circuit unit 102 further contains a lamp circuit 112 which remains lit until contact C-108 of relay C is unlatched by the user's depressing of button switch 105 to thereby give the user a visual indication that the mailbox has been serviced by the mailman.

The switching means contains circuit means coupled to the pneumatic valve 42 to initiate the operation of the pneumatic valve to raise the mailbox. The signal from the mailman's transmitter received by antenna 103 energizes solenoid A to close contact A-113 to thereby apply a voltage to timing means shown as time-delay relay E. The application of voltage to the solenoid E of the time-delay relay causes it to close its delay contact E-114 for 60 seconds only to lock in the relay E for that time until the 115-volt supply voltage source is reopened by contact E-114 after the 60 second delay has expired. A voltage is thereby applied to valve 42 for 60 seconds to thereby open the valve to permit compressed air stored in the storage tubes 39 to be released through the air diffuser 43 into the space formed between the bottom of the outer cylinder 21 and the piston 29 as shown in FIG. 1. Relay E also opens normally closed contacts E-116 for 60 seconds to deactivate the motor of compressor 54, shown schematically as C.M. in FIG. 14, while the valve 42 is transmitting compressed air to the space between the outer cylinder 21 and the piston 29.

The storage pipes 39 which normally store approximately one cubic foot of air at 100 psig release the air in response to the opening of valve 42. The air is released through the tubes 41, the collection chamber 40, the valve 42, and the air diffuser 43 to expand into the space beneath the piston 29. The inner cylinder 23 thereby rises in response to air pressure against the piston 29. It raises the middle cylinder 22 which is magnetically latched to the inner cylinder by magnets 62 which are secured to steel ring 63 by a magnetic force in the order of eighty pounds. The air circulated by the air diffuser 43 circulates inside the mechanism and between outer cylinder 21 and middle cylinder 22 through the gap between the middle and outer cylinders. The air is retained in the system by the steel ball 53 of the check valve 52 which closes the valve while the air pressure from the air circulated by the diffuser 43 exceeds atmospheric pressure.

The middle and inner cylinders move up in unison until steel plates 66 contact magnets 67 which are secured to the top of outer cylinder 21. The forty-pound pull of the magnets 67 retains the middle cylinder 22 in the position shown in FIG. 3 after the pressure on piston 29 breaks the magnetic latching between inner cylinder 23 and middle cylinder 22 to thereby prevent the middle cylinder 22 from sliding downwardly while the outer cylinder continues to be urged upward by the expanding air circulated by the air diffuser 43.

As the inner cylinder 23 continues to move upwardly while the middle cylinder is magnetically latched to the outer cylinder, the plastic top 82 disengages contact with the cap 79. A small amount of air escapes between the inner cylinder 23 and the cap 79 until the stop 84 on the inner cylinder 23 is urged against the rubber seal 81 of the cap 79. Air leakage from within the system is now zero.

The air pressure continues to urge the piston 29 upwardly against the force of springs 36 until the spring tension of the springs is overcome and the piston reaches the top of its upward cycle as shown in FIG. 4. The rack 32 is secured to the top of the piston moves upwardly to thereby translate its vertical motion to rotary motion of the pinion 33 to rotate the mail receiving receptacle 28 to the open position as shown in FIG. 4. The piston 29 is urged against the upper seal 87 of the inner cylinder 23 to retain the system airtight in this position.

The movement of the middle cylinder 22 to its extended position requires approximately two seconds. The movement of the inner cylinder 23 to its extended position requires approximately two seconds, and the 90° rotation of the mail receiving receptacle 28 by the rack and pinion and the lead weights 55 requires approximately one second. The entire opening cycle, therefore, requires approximately five seconds. The time-delay relay E has a time delay of approximately sixty seconds. The mailbox is thereby opened for a period slightly in excess of sixty seconds and in the order of sixty-five seconds. Under normal circumstances, this provides sufficient time for the mailman to collect and/or deposit any mail.

The air pressure inside the unit when in the fully extended position is in the order of 1 to 2 psig, depending on the initial pressure of the compressed air stored in the storage pipes 39 which, in the preferred embodiment, is in the order of 95 to 100 psig. The internal volume of air when the mechanism is in its fully extended position is in the order of 3.75 cubic feet, excluding the volume of tubes 39, which itself is about 1.0 cubic foot. While the mailbox is being extended upwardly, a maximum of about three cubic feet of air is allowed to escape. The final pressure inside the unit is therefore in the order of 1 to 2 psig when the mechanism reaches its fully extended position. Without any leakage of air while the mechanism is extending upwardly, the internal pressure would be excessive and in the order of 15 psig at the fully extended position. Therefore, the right amount of leakage of air is necessary for proper operation of the mechanism.

After the termination of the sixty-second time delay period of time-delay relay E, the operation of relay E begins the retraction cycle. When relay E is de-energized, normally closed contact E-116 closes once again. A pressure electric switch 117 is connected in series with the normally closed contact E-116. The pressure electric switch 117 is operated in response to a sensor (not shown) which senses the air pressure of the air stored in the storage pipes 39. In the preferred embodiment, the normally closed PE switch 117 opens when the internal pressure exceeds 100 psig and reverts back to its normally closed state when the internal air pressure falls below 95 psig. Thus, when the internal pressure falls below the desired level of 95 psig, a voltage is applied through normally closed contact 117 via normally closed contact E-116 to the compressor 54 to bring the internal pressure back up to 100 psig at which point the normally closed contact 117 opens to deactivate the compressor 54.

At the end of the sixty-second delay period of time-delay relay E, normally closed contact E-116 closes once more and since the internal air pressure is far below 95 psig, contact 117 is normally closed as well. A voltage from the 115-volt supply line is therefore applied via contact 117 and contact E-116 to the compressor 54 to begin compression of the air beneath piston 29.

As soon as the internal air pressure begins to decrease, the spring tension of springs 36 pulls piston 29 downwardly to thereby pull rack 32 downwardly. Pinion 33 is thereby rotated to close the mail container 28. As the piston 29 begins to move downwardly from engagement with seal 87 to engagement with seal 86, as shown in FIG. 2, internal air begins to leak out through the gap between the piston 29 and inner cylinder 23 and rotates the receptacle 28 at a relatively rapid speed to thereby minimize any rain or snow that might fall into the receptacle 28 during this short period of time. Once the mail receptacle is rotated to the vertically closed position, as shown in FIG. 3, the engagement of the piston 29 with seal 86 prevents further leakage of air from the system.

The internal air pressure continues to decrease as the compressor 54 continues to compress air into the storage pipes 39. Inner cylinder 23 descends quite rapidly because of the additional leakage between it and cap 79 until magnets 62 engage the steel ring 63 to latch inner cylinder 23 to middle cylinder 22 once again. The eighty-pound pull of the magnets 62 insures a tight fit between the plastic top 82 and the cap 79. The movement of the inner and middle cylinders stops for an abrupt moment until the internal pressure is decreased by the compressor 54 to unlatch the steel plate 66 from the magnetic attraction to magnet 67. The compressor 54 continues to reduce the internal air pressure until the middle cylinder 22, magnetically latched to the inner cylinder 23, is returned to the fully retracted position as shown in FIG. 1.

The closing cycle requires approximately two to three minutes. After the mailbox is in the fully retracted position, however, compressor 54 continues to operate because the storage pipes 39 have not yet been filled with air to the desired pressure of 100 psig. This continued operation of the compressor 54 provides for a further tight closure. When the internal pressure falls slightly below atmospheric pressure, the check valve 52 opens to permit additional air from the atmosphere to be admitted through the tube 48, the orifice 59, through the air path shown in FIG. 2 and between the buttons 61 until the pressure in the storage pipes 39 reaches 100 psig. Since the normally closed PE switch 117 is set to open when it senses internal pressure in the storage pipes 39 of 100 psig, the contact of PE switch 117 will open to thereby de-energize the compressor 54 to completely terminate the retraction cycle. The compression is required to continue for a period in the order of eleven minutes to bring the pressure in the storage pipes 39 up to 100 psig. The seven gallons of water surrounding the storage tubes 39 absorbs the heat generated during the compression cycle which is ordinarily in the order of 100 BTU's. The compressor is ordinarily submerged in a container (not shown) having approximately four pounds of water to prevent overheating of the compressor during the compression cycle.

The user may collect the mail by going to the mailbox when it is opened by the mailman at the time the mail is deposited in the mail container. The user is informed that the mailman is opening the mailbox by the audible signal from the chime 111, which lasts for approximately forty seconds due to time-delay relay D, or the visual signal from the lamp 112 in the user's house.

More often that not, however, the user is not at home or cannot go out to the mailbox while the mail is being deposited by the mailman. After the mailman has deposited the mail and the mailbox has returned to the fully retracted position, the lamp 112 in the user's house remains lit and the user must then open the mailbox himself to withdraw the mail.

The user may open the mailbox with a transmitter of his own which transmits a signal to the antenna 103 to energize the solenoid of a relay B of the relay circuit means 104. Since the solenoid of relay C was energized when the mailman deposited the mail, contact C-108 is, at this time, in the closed position to feed a voltage to the lamp 112 which, as indicated above, provides the signal to the user that the mail has been deposited. The energization of relay B opens the normally closed contact B-107 to deactivate the solenoid of relay C to thereby open contact C-108 to turn the lamp 112 off.

The relay B also closes normally open contact B-118 to apply an electrical potential to the solenoid of time-delay relay E. This causes normally open contact E-114 to close and normally closed contact E-116 to open. The valve 42 is thereby opened to permit the air pressure to increase within the internal mechanism to raise the mailbox in the same manner as described above when the postman transmits a signal from his transmitter to the antenna 103. Similarly, voltage is prevented from reaching the compressor 54 by the opening of contact E-116 during the delay period of 60 seconds caused by time-delay relay E. Thus, the box opens in approximately 4 to 5 seconds and remains open for approximately 60 seconds for the user to withdraw the mail.

After the termination of the 60-second delay period, contact E-114 reverts to its normally open position and contact E-116 reverts to its normally closed position. Since the pressure in the air tubes is below 95 psig, the contact of pressure electric switch 117 remains closed to apply voltage to the compressor 54 to effectuate the retraction of the mailbox. As indicated above, the compression of the air into the storage pipes 39 will continue until the pressure therein reaches 100 psig, at which time the contact of pressure electric switch 117 opens. The retraction of the mailbox is then fully completed. With the pressure in the storage pipes 39 increased to 100 psig, the mailbox is then ready to open in response to the next signal from the mailman or the user.

Means are provided to signal the mailman that the owner has deposited outgoing mail to be picked up by the mailman. The signaling means in the preferred embodiment is a lamp 119 mounted in lamp post 51 and shown diagrammatically in FIG. 13 and schematically in FIG. 14. The lamp is series connected to a normally open contact B-121 which is controlled by the solenoid of relay B. Contact B-121 is series connected to normally closed pressure electric switch 122. Pressure electric switch 122 is set to open when the internal pressure exceeds 7 psig and reverts to the closed stage when it falls below 3 psig. Relay means are connected in parallel with the lamp 119 with the relay solenoid 123 of relay F coupled across lamp 119 and normally open contact F-124 coupled across contact B-121 which is in series with pressure electric switch 122. Normally closed contact A-126 is coupled in series with contact F-124.

When the owner desires to open the mailbox for purposes of depositing outgoing mail, transmitter may be activated to transmit a signal to antenna 103. The solenoid of relay B is thereby energized to open the mailbox in the manner described above.

When the mailbox is in the fully extended position, the owner activates the transmitter a second time to transmit a second signal to the antenna 103 to energize the solenoid relay B a second time to close contact B-121. Since the internal pressure of the system is below 3 psig in the extended position, pressure electric switch 122 is closed to thereby transmit a voltage across the lamp 119 as well as the solenoid of relay F. Relay F is thereby energized to close contact F-124 to complete a circuit through normally closed contact A-126 to thereby latch relay F to maintain the lamp 119 lit to signal the mailman that there is outgoing mail in the box to be collected.

The lamp 119 remains lit until the mailman transmits a signal to the antenna 103 to energize the solenoid of relay A to open the normally closed contact A-126 to open the circuit to the lamp 119 and unlatch relay F.

Alternatively, the user may turn off lamp 119 by depressing button switch 105.

Heating means is provided for maintaining the temperature sufficiently high in the mailbox to prevent freezing of any of the water used to cool the air storage pipes and the compressor. The heating means further prevents freezing of any water that condenses inside the mechanism. The heating means is in the form of a standard heating element 127 connected in series with a thermostat 128 which is set preferably at a temperature in the order of 60° F.

Ordinarily, any condensation of moisture that has collected at the bottom of outer cylinder 21 is evaporated and discharged with the 3 cubic feet of air that is allowed to escape each time the mailbox is opened. A drain from the bottom of the outer cylinder 21 is therefore ordinarily not required.

However, in the event that the mailbox is in an area in which the relative humidity is high, drainage means may be provided to drain off any moisture that condenses at the bottom of the outer cylinder 21. The drain means is in the form of a drain tube 129 having a drain inlet orifice 131 at the bottom of inner cylinder 21 and a discharge orifice 132 positioned slightly above the column of water which surrounds the air storage pipes 39 as shown in the vertical section in FIG. 1 and in cross section in FIGS. 7 and 8. A second drain tube 133 is positioned to have its orifice slightly above the desired level 133 of the cooling water to drain off any excess water into any suitable underground drain.

In the completely retracted position, the unit is effectively sealed from the outside. Water and dirt are prevented from collecting on cover 72 and top 82 in view of the curved shaped of the top of the box. Cleaning the exposed parts can be accomplished by simply washing them with any suitable household or garden hose. The unit is sealed from the outside to prevent snow, rain, dirt and dust from getting into the internal mechanism. The mechanism contained within the waterproof membrane 44 may be removed in one piece for maintenance or repair. The outer housing shell 24 remains permanently buried in the ground. The lamp post 51 remains stationary and ordinarily never needs to be serviced.

The lamp post 51 is desirably spaced away from the mailbox by a foot or more to prevent snow that collects on the box from inundating the lamp post when the box rises. As shown in FIG. 5, an underground cable 134 connects the supply voltage from the user's household to a junction box 136. The junction box 136 is connected through another underground cable 137 to the mechanism. The junction box is further connected by another cable 138 to the lamp post 51 which is connected by an air tube 48 to the mechanism. The cables surround and protect the electrical wires used in the system.

Thus the retractable mailbox assembly of the present invention provides a mailbox that can only be operated by the owner or the mailman to obtain access to the interior thereof. The pneumatic feature provides a durable, quick-acting mechanism for raising and lowering the mailbox. The mailbox is concealable in an opening under the ground adjacent the curb to mount flush with the surrounding area.

Obviously many modifications and variations of the present invention are possible in the light of the above teachings. For example, the lamp post may be replaced by a front lawn lantern or any type of yard lantern which is aesthetically appealing. The lantern like the lamp post may be used to show the location of the mailbox and indicate to the mail carrier that there is mail to be picked up. The lantern post may, in addition, have the user's house number mounted thereon. Furthermore, the lantern post may be used for air intake and to hose the antenna as in the case of the lamp post described above. It is therefore to be understood that within the scope of the appended claims the invention may be practiced otherwise than as specifically described.

I claim:

1. A retractable mailbox assembly comprising:

a hollow open ended housing recessed in the ground with the open end thereof substantially flush with the surrounding surface;

a plurality of telescopic members positioned within said housing with one of said members having a mail receiving receptacle mounted at the top thereof;

displacing means responsive to a pneumatic force for raising at least the innermost of said telescopic members a linear height to thereby enable mail to be deposited or withdrawn from said receptacle; and retracting means for effectuating the retraction of said displacing means from said linear height, comprising a compressor operatively mounted within said mailbox assembly for compressing air within said mailbox assembly.

2. The invention as described in claim 1 and wherein said plurality of telescopic members comprises:

an outer cylinder mounted stationary within said housing;

a middle cylinder mounted concentrically in said outer cylinder; and an inner cylinder having said mail receiving receptacle mounted thereon whereby said middle cylinder is raised a first predetermined height by said displacing means and said inner cylinder is further raised a second predetermined height to said linear height by said displacing means.

3. The invention as described in claim 2 and further comprising a first latching means for latching said middle and inner cylinders together to rise in unison to said first predetermined height.

4. The invention as described in claim 3 and further comprising a second latching means for retaining said middle cylinder at said first predetermined height whereby said first latching means is unlatched to thereby enable said inner cylinder to rise to said second predetermined height.

5. The invention as described in claim 4 and wherein said first and second latching means comprise magnetic latches, respectively.

6. A retractable mailbox assembly comprising:

a plurality of concentric longitudinal members with the innermost having a mail receiving receptacle pivotally mounted at the top thereof;

rising means for pneumatically raising each of said plurality of longitudinal members except one a respective predetermined height;

circuit means operatively coupled to said rising means and responsive to an external signal to activate said rising means; and retraction means for effecting a retraction of said concentric longitudinal members each from its respective predetermined height and operatively coupled to said circuit means, wherein said circuit means includes timing means for activating said rising means for a predetermined period of time and wherein said retraction means includes a compressor operatively controlled by said timing means for effecting said retraction at the termination of said predetermined period of time.

7. The invention as described in claim 6 and wherein said circuit means further includes:

signal receiving means; and control circuit means having, control element means coupled to said signal receiving means and responsive thereto, and circuit connecting means operatively responsive to said control element means and coupled to said rising means to activate said rising means in response to an external signal received by said signal receiving means.

8. The invention as described in claim 7 and wherein said signal receiving means is an antenna operative to receive signals from a transmitter operated by a mailman or a user and said control element means comprises;

a first relay solenoid responsive to the signal received from said transmitter operated by the mailman, and a second relay solenoid responsive to the signal received from said transmitter operated by the user.

9. The invention as described in claim 7 and wherein said rising means includes a pneumatic valve operative to release air pressure and said circuit connecting means is operatively coupled to said pneumatic valve.

10. The invention as described in claim 9 and further including timing means coupled to said circuit connecting means and operatively connected to said pneumatic valve for retaining said pneumatic valve in its operative state to release air for a predetermined period of time.

11. The invention as described in claim 10 and wherein said timing means is a time-delay relay having a solenoid coupled to said circuit connecting means.

12. A retractable mailbox assembly comprising:

a hollow open ended housing recessed in the ground with the open end thereof substantially flush with the surrounding surface;

a plurality of telescopic members positioned within said housing with one of said members having a mail receiving receptacle mounted at the top thereof;

displacing means responsive to a pneumatic force for raising at least the innermost of said telescopic members a linear height to thereby enable mail to be deposited or withdrawn from said receptacle; and means for imparting pneumatic pressure for providing said pneumatic force to said displacing means, comprising air storage means and a pneumatic valve operatively connected thereto, said air storage means comprising a plurality of water cooled air storage pipes.

13. The invention as described in claim 12 and further comprising a compressor operatively mounted within said mailbox assembly for effectuating the retraction of said displacing means from said linear height.

14. The invention as described in claim 13 and wherein said compressor is operatively connected to said air storage pipes to compress air within said mailbox assembly into said storage pipes.

* * * * *